United States Patent [19]

DeFilipps et al.

[11] 4,239,404

[45] Dec. 16, 1980

[54] PAPER MANAGEMENT SYSTEM FOR A PRINTING DEVICE

[75] Inventors: Fred A. DeFilipps, Maitland; Roy O. Lipper; Luther R. Winters, Jr., both of Orlando; Larry A. Nordstrom, Oviedo; Daniel J. Szechy, Sanford, all of Fla.

[73] Assignee: Scope Data Incorporated, Orlando, Fla.

[21] Appl. No.: 934,597

[22] Filed: Aug. 17, 1978

[51] Int. Cl.[3] ..... B41J 11/26

[52] U.S. Cl. ..... 400/613; 242/57; 400/708

[58] Field of Search ..... 400/613, 617, 708, 708.1; 200/61.16; 242/57; 250/338, 351, 571

[56] References Cited

U.S. PATENT DOCUMENTS

| | | | |
|---|---|---|---|
| 1,088,865 | 3/1914 | Bancroft | 400/708 |
| 3,049,212 | 8/1962 | Fondiller | 400/708 X |
| 3,292,170 | 12/1966 | D'Angelo | 200/61.16 X |
| 3,715,085 | 2/1973 | Kobayashi | 200/61.16 X |
| 3,845,320 | 10/1974 | Winberg | 250/571 |
| 3,845,850 | 11/1974 | Herr et al. | 400/613 X |
| 3,906,232 | 9/1975 | Meihofer | 250/338 X |

*Primary Examiner*—Paul T. Sewell

*Attorney, Agent, or Firm*—Duckworth, Hobby, Allen & Pettis

[57] ABSTRACT

A dispenser for a roll of paper, a deflectable paper guide and systems for indicating when a predetermined amount of paper is left on the roll and when the supply of paper is totally exhausted. The paper dispenser is mounted on a printer frame and includes first and second cylindrical rollers having large and small diameter sections which permit the roll of paper to be readily inserted in and removed from the dispenser assembly. The deflectable paper guide is positioned between the paper dispenser and a fixed paper guide and includes a bar oriented parallel to the longitudinal axis of the roll of paper and biaser which forms a loop in the paper guide. The low paper quantity indicating system includes an infra red transmitter and an infra red receiver which are positioned in axial alignment on opposite ends of the roll of paper. An indicating device indicates when a clear path is established between the transmitter and the receiver which is indicative of a predetermined amount of paper remaining on the roll. The paper out indicating system includes a groove which is formed in the printer device drive roller and an aperture in a fixed paper guide which is positioned adjacent to the drive roller. The aperture is aligned with the groove in the drive roller. A switch having a long, readily deflectable arm is positioned so that the arm can be deflected through the aperture.

9 Claims, 5 Drawing Figures

3
3
10
12
14
16
18
20
22
24
26
28
30
32
40
46
48
50
52
54
56
58
76
78

LED
INDICATOR CIRCUIT
10
12
16
20
40
42
44
46
50
58
60
62
64
66
68
70
72
74
76

10
14
16
18
20
22
24
26
28
30
32
34
36
38

PAPER MANAGEMENT SYSTEM FOR A PRINTING DEVICE

BACKGROUND OF THE INVENTION

1. Field of the Invention

This invention relates to printing devices, and more particularly, to printing devices which utilize continuous lengths of paper wound upon a cylindrical roll.

2. Description of the Prior Art

High speed automatic receive-only printers print characters at high rates of speed on a single continuous length of paper which is dispensed from a roll of paper coupled to the printing device itself. These devices are designed to function automatically and do not require the constant attention of an operator. A housing for the printing device typically conceals the roll of paper which the device prints characters on.

Since it is highly undesirable for a printing device of the type described above to continue printing characters after the supply of paper has been exhausted and since it is impossible for an operator to visually ascertain the quantity of paper remaining without removing the cover of the device, it is desirable that the printing device incoporate a system for indicating when a predetermined quantity of paper remains on the roll and when the supply of paper has actually been exhausted.

Since these printing devices also print at extremely high rates which are typically several hundred characters per second, continuous operation of the printing device will rapidly exhaust the paper contained on a single roll. It is therefore advantageous to incorporate a paper dispenser within the printing device with which the rolls of paper are readily removed and replaced with a fresh roll.

Since paper is conveyed by a small electric motor from the roll through the printer, it is desired to minimize the amount of force which must be exerted by the motor on the roll of paper. Doing so not only minimizes the cost of the motor, but also reduces its size permitting the entire printing device to be designed to have a overall smaller physical size.

SUMMARY OF THE INVENTION

The present invention contemplates a dispenser for rotatably supporting a length of material wound upon a hollow cylindrical core. The dispenser is mounted on a frame having first and second sides. A first cylindrical roller includes a base which is coupled to the first side of the frame, a large diameter section which is adjacent to the first side of the frame, and a small diameter section. A second cylindrical roller is coupled to the second side of the frame in axial alignment with the first roller and includes a base adjacent to the second side of the frame, a large diameter section adjacent to the base, and a small diameter section. The diameter of the large diameter sections of the first and second rollers is less than the inner diameter of the core upon which the material is wound.

A deflectable paper guide is provided in a printing device which includes a frame and means for rotating a paper feed roller to incrementally transport a continuous length of paper from a freely rotatable roll across a fixed paper guide to the printing area. The paper guide includes a bar oriented parallel to the longitudinal axis of the roll. The bar is positioned between the roll and the fixed paper guide. Biasing means is coupled to the bar and to the frame order to exert a biasing force on the paper to form a loop in the paper which is transported between the roll and the fixed paper guide. The biasing means permits the bar to be deflected and the shape of the loop to be altered as paper is incrementally unwound from the roll by the rotating means.

A system for indicating when a predetermined amount of material remains on a core upon which a length of material is wound. This system includes transmitting means which is coupled to the frame at a point adjacent to the first end of the core at a radial position between the full and empty states of the cylindrical roll of material. Detecting means is coupled to the frame at a point adjacent to the second end of the core and in axial alignment with the transmitting means.

The detecting means detects the signal from the transmitter when the path between the transmitting means and the detecting means is uncovered after a predetermined amount of material remains wrapped about the core.

In a printing device which includes a rotatable paper drive roller and a fixed paper guide positioned adjacent to the drive roller to form a path between the drive roller and the paper guide for passing a length of paper, a system for indicating the absence of paper from the path is provided. This system includes a groove in the drive roller at a first position and an aperture in the paper guide adjacent to the groove in the drive roller. Indicator means is coupled to the printing device at a location adjacent to the aperture and includes an arm which is biased to a first position through the aperture into the groove when paper is absent from the path. The arm of the indicator means is deflected into a second position when the groove is covered by paper within the path.

DESCRIPTION OF THE DRAWING

The invention is pointed out with particularity in the appended claims. However, other objects and advantages together with the operation of the invention, may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
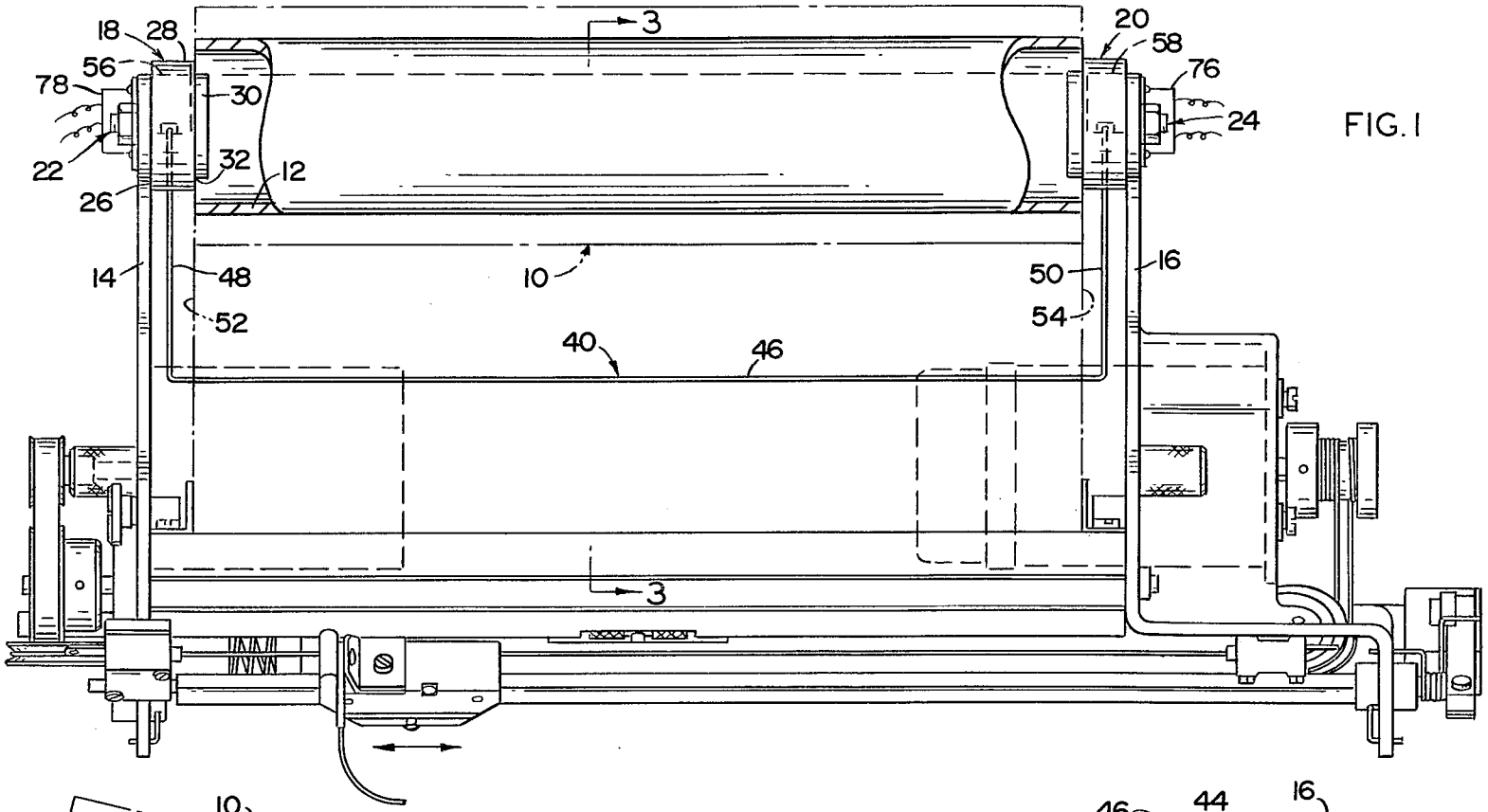
FIG. 1 is a view from above of a printing device which incorporates the present invention.
Figure 3:
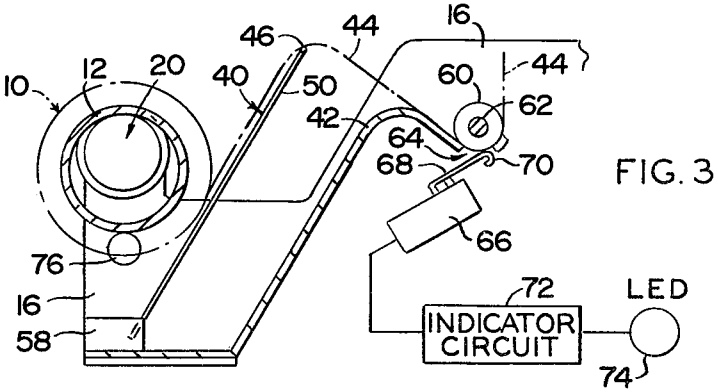
FIG. 3 is a sectional view of the printing device illustrated in FIG. 1, taken along section line 3—3.
Figure 2:
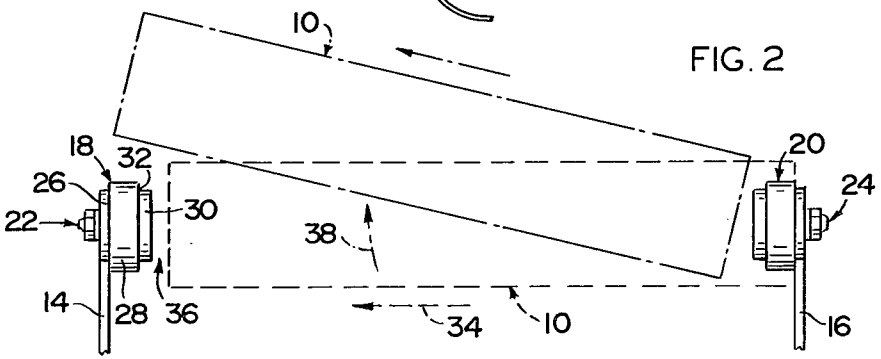
FIG. 2 is a partial elevational view of the dispenser of the present invention.

Referring now to FIGS. 1, 2 and 3, a continuous roll of paper 10 is formed on a hollow cylindrical core 12. The frame of the printing device includes first and second vertically extending sides 14 and 16. Rollers 18 and 20 are coupled respectively to sides 14 and 16 of the frame of the printing device. Shaft and ball bearing assemblies 22 and 24 rotatably couple rollers 18 and 20 about the centers thereof to the frame elements 14 and 16.

As can be seen, rollers 18 and 20 are physically identical and are positioned in axial alignment with one another. Each roller, such as roller 18, includes a flat base 26 which is positioned adjacent to side 14. Roller 18 also includes a large diameter section 28 and a small diameter section 30. The diameter of large diameter section 28 must be equal to or slightly less than the inner diameter of core 12.

The junction between large diameter section 28 and small diameter section 30 forms a cylindrical groove 32 which is parallel to the base 26 of roller 18. The physical characteristics of roller 20 are identical to those of roller 18 as described above. The spacing between frame sides 14 and 16 must be greater than the length of core 12 and the width of paper 10 contained on core 12. FIG. 3 indicates the manner in which core 12 is suspended upon roller 20.

FIG. 2 indicates the manner of removing or replacing the paper roll 10 from the dispenser of the present invention. The first removal step is indicated by arrow 24. The roll of paper is lifted vertically upward and displaced either to the right or the left. In FIG. 2, a rightward displacement is illustrated. This rightward displacement of paper roll 10 provides a space indicated generally by reference number 36 between the left and of paper roll 10 and the small diameter section of roller 18. The left end of paper roll 10 is displaced in the direction indicated by arrow 38 and the right end of paper roll 10 is then removed from roller 20. Paper roll 10 is thus readily removed from or replaced upon the dispenser of the present invention and no hardware must be removed from or replaced on the dispenser. Since the lateral spacing between cylindrical grooves 32 and rollers 18 and 20 is precisely equal to the length of core 12, paper roll 10 is maintained in a fixed lateral position upon the dispenser assembly.

Since paper roll 10 is typically rotated at a relatively small angular velocity, it is possible to rigidly secure rollers 18 and 20 to sides 14 and 16 of the printing device. Rubbing contact will then be established between the end sections of core 12 and the small diameter sections of rollers 18 and 20, but this will typically not interfere with normal operation.

Referring now to FIGS. 1 and 3, the deflectable paper guide of the present invention will now be described. The path of paper flow from paper roll 10 to fixed paper guide 42 is indicated by the dotted line identified by reference number 44.

Paper guide 40 includes a bar 46 which is oriented parallel to the longitudinal axis of paper roll 10 and is positioned between the paper roll and fixed paper guide 42. Biasing means in the form of two parallel oriented rods 48 and 50 is coupled to the ends of bar 46 at positions between frame sides 14 and 16 and the outer edges 52 and 54 of the paper which is being transported from paper roll 10 to paper guide 42.

The remaining ends of rods 48 and 50 are rigidly coupled to mounting blocks 56 and 58 which are in turn rapidly coupled to the lower portion of the frame of the printing device.

Rods 48 and 50 are fabricated from a spring-like material such as piano wire and maintain bar 46 in the paper path 44 to form the loop-like paper path configuration as illustrated in FIG. 3. As paper is incrementally fed into the printing device, the bar of the deflectable paper guide is deflected back and forth toward fixed paper guide 42. This movement of the delfectable paper guide alters the size of the loop formed between the paper roll and fixed paper guide 42 and acts as a shock absorber which permits a smaller electric motor to be used to feed the paper to the printing area. In order to maintain the flexibility of the deflectable paper guide it is essential that rods 48 and 50 be oriented neither perpendicular to nor parallel to the plane formed by the paper traveling from paper roll 10 to fixed paper guide 42. Rods 48 and 50 and bar 46 are coupled to lie on a single plane to insure that the paper passing over bar 46 is uniformly fed into fixed paper guide 42.

FIG. 3 indicates that a drive roller 60 which is coupled to an electric drive motor (not shown) actually moves the paper on paper roll 10 over the deflectable paper guide onto the fixed paper guide 42 and thence to the printing area. The diameter of drive roller 60 is constant along its entire length except for a narrow groove in the center thereof as is indicated by FIG. 3 by reference number 62. An aperture indicated generally by arrow 64 is formed in fixed paper guide 42. This aperture is positioned directly over groove 62 formed in drive roller 60 and is of generally the same width as groove 62.

A switch 66 is coupled to the frame of the printing device and includes an arm 68 which is positioned over and aligned with the groove in drive roller 60 and the aperture in paper guide 42. The width of arm 68 is slightly narrower than the width of groove 62 or aperture 64 so it can fit within groove 62. Arm 68 of switch 66 is biased so it is deflected through aperture 64 into groove 62 when paper is not present on drive roller 60.

When paper is present in the path indicated by reference number 44 lying between fixed paper guide 42 and drive roller 60, the surface of the paper prevents arm 68 from being displaced into groove 62. Arm 68 includes a curved end section 70 which permits it to smoothly glide over the lower surface of the paper passing through path 44.

As is indicated in FIG. 3, when paper is present is path 44 arm 68 of switch 66 is maintained in a first position in which the switch contacts are open. When the supply of paper on paper roll 10 is depleted and drive roller 60 has dispensed the last of the paper past aperture 64, the end 70 of switch 68 will be displaced into a second position lying within groove 62 of drive roller 60 and the contacts of switch 66 will be closed. The closure of the contacts of switch 66 actuates indicator circuit 72 which illuminates light emitting diode 74 to indicate to the operator of the printing device that the printing device should be shut down and the supply of paper replenished.

Figure 4:
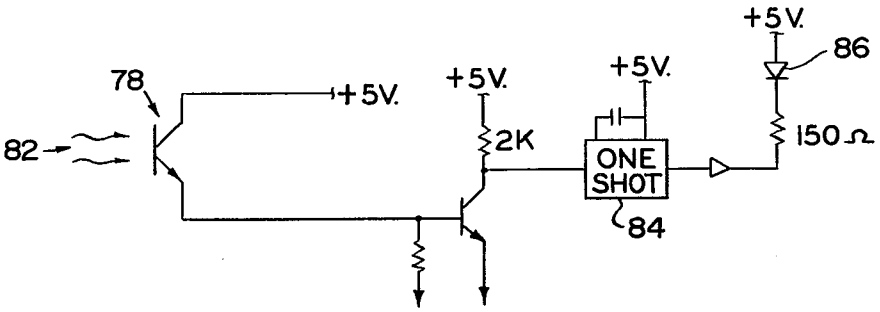
FIG. 4 is an electrical schematic diagram of a portion of the low paper quantity indicating system.
Figure 5:
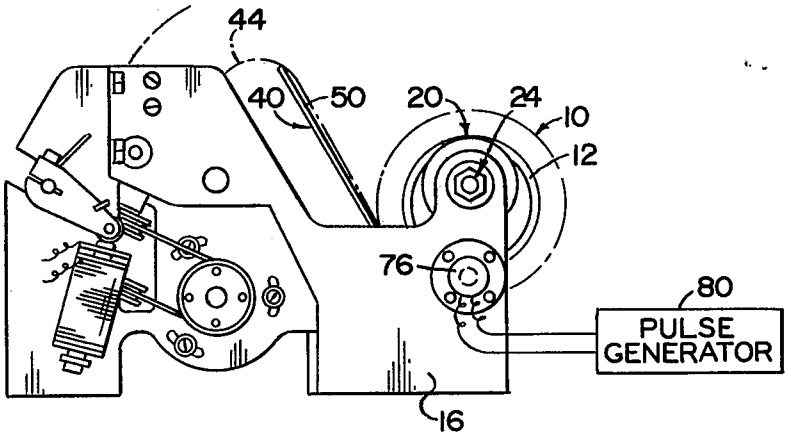
FIG. 5 is a side elevational view of the printing device illustrated in FIG. 1.

Referring now to FIGS. 1 and 4, a system for indicating when a predetermined amount of paper remains on paper roll 10 as infra red transmitter 76 and infra red detector 78. Transmitter 76 and detector 78 are axially aligned and positioned at a point along the radius of paper roll 10 such that the beam of infra red energy transmitted from transmitter 76 will be blocked by the paper until a predetermined amount of paper remains on roll 10. At this point a path between transmitter 76 and detector 78 will be opened and the detector will be activated by the infra red signal from transmitter 76.

A pulse generator 80 continuously pulses infra red transmitter 76 at $\frac{1}{8}$ second intervals with approximately one half ampere of current. This permits transmitter 76 to be operated at an average power output within permissable limits, but with relevantly powerful short duration output pulses of infra red energy.

Referring now to FIG. 4, an electrical schematic diagram of infra red detector 78 and additional indicating circuitry is illustrated. When pulses of infra red energy indicated by reference number 82 are detected by infra red detector 78, it generates an output signal which has a duration equal to that of the transmitted infra red signal. The output signal from transistor 78 activates one shot 84 which in the preferred embodiment is designed to have an output pulse duration greater than that of the pulsed signal generated by infra red transmitter 76. Thus the repetitive reception by detector 78 of pulsed infra red signals will create a continuous output from one shot 84. The output of one shot 84 illuminates light emitting diode 86. The illumination of light emitting diode 86 indicates to the operator of the printing device that the supply of paper remaining on paper roll 10 has reached a predetermined quantity and the operator can act accordingly.

As a result of the co-operative action of the paper low quantity detector and the paper out detector, it is no longer necessary for an operator to periodically remove the cabinet from a printing device in order to determine the amount of paper remaining on the paper roll or to determine when the supply of paper has been exhausted.

It will be apparent to those skilled in the art that the disclosed paper management system may be modifed in numerous ways and may assume many embodiments other than the preferred forms specifically set out and described above. Accordingly, it is inteded by the appended claims to cover all such modification of the invention which fall with the true spirit and scope of the invention.

We claim:

1. In a printing device having a frame and including a rotatable paper drive roller and a fixed paper guide positioned adjacent said drive roller to form a path between said drive roller and said paper guide for passing a length of paper, and a dispenser coupled to said frame for rotatably supporting a length of material wound upon a cylindrical core having first and second ends, said core plus said material having a first radius when full and a second radius when material is depleted, a paper quantity indicating system comprising:

a. means coupled to said frame at a point adjacent the first end of said core at a radial position between the first radius and the second radius for transmitting a signal toward the second end of said core in a direction parallel to the axis of said core;

b. means coupled to said frame at a point adjacent the second end of said core in axial alignment with said transmitting means for detecting said signal when the path between said transmitter means and said detecting means is uncovered after a predetermined amount of material remains on said core;

c. a groove in said drive roller at a first position;

d. an aperture in said paper guide adjacent said first position; and e. indicator means coupled to said printing device at a location adjacent said aperture and having an arm biased to a first position through said aperture into said groove when paper is absent from said path, said arm being deflected into a second position when said groove is covered by paper within said path.

2. The system of claim 1 wherein said indicator means further includes a switch coupled to one end of said arm.

3. The system of claim 2 wherein said switch includes a microswitch.

4. The system of claim 1 wherein the signal generated by said transmitting means is an optical signal.

5. The system of claim 1 wherein the signal generated by said transmitting means includes an infra red signal.

6. The system of claim 1 further including means for indicating when said detecting means has detected the signal generated by said transmitter.

7. The system of claim 6 wherein said indicating means includes means for illuminating a light emitting diode.

8. The system of claim 6 wherein said indicating means includes means for generating a visual signal.

9. The system of claim 2 wherein said indicator means includes:

a. electronic circuit means coupled to said switch for generating an output signal when said arm is in the first position; and b. means coupled to said electronic circuit means for generating a visual or aural output signal in response to the output signal from said electronic circuit means.

* * * * *